US010486443B2

(12) United States Patent
Yamamoto et al.

(10) Patent No.: US 10,486,443 B2
(45) Date of Patent: Nov. 26, 2019

(54) CUTTING DEVICE

(71) Applicant: Roland DG Corporation, Hamamatsu-shi, Shizuoka (JP)

(72) Inventors: Shinya Yamamoto, Hamamatsu (JP); Kiyoshi Fujimoto, Hamamatsu (JP); Masakazu Igarashi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/110,013

(22) Filed: Aug. 23, 2018

(65) Prior Publication Data

US 2019/0061386 A1 Feb. 28, 2019

(30) Foreign Application Priority Data

Aug. 24, 2017 (JP) ..... 2017-160886

(51) Int. Cl.

| | |
|---|---|
| ***B41J 11/70*** | (2006.01) |
| ***B26D 5/08*** | (2006.01) |
| ***B26D 1/06*** | (2006.01) |
| ***B26D 5/20*** | (2006.01) |
| ***B65H 35/06*** | (2006.01) |

(52) U.S. Cl.

CPC ..... *B41J 11/70* (2013.01); *B26D 1/065* (2013.01); *B26D 5/086* (2013.01); *B26D 5/20* (2013.01); *B41J 11/706* (2013.01); *B65H 35/06* (2013.01)

(58) Field of Classification Search

CPC ..... B41J 11/70; B41J 11/706; B65H 35/06; B65H 2801/36; B26D 5/20; B26D 5/086; B26D 1/065

See application file for complete search history.

(56) References Cited

U.S. PATENT DOCUMENTS

2012/0204689 A1* 8/2012 Shimakawa ..... B26D 5/40 83/62

FOREIGN PATENT DOCUMENTS

JP 2011-218456 A 11/2011

* cited by examiner

*Primary Examiner* — Geoffrey S Mruk

(74) *Attorney, Agent, or Firm* — Keating & Bennett, LLP

(57) ABSTRACT

A controller includes a cutter movement controller that controls a value of an electric current to flow in a voice coil motor to apply a first electromagnetic force to a holder in a downward direction for a first time duration, then to apply the first electromagnetic force to the holder in an upward direction for a second time duration shorter than the first time duration, to pause the supply of the electric current to the voice coil motor for a third time duration longer than the second time duration, then to apply a third electromagnetic force, which is smaller than, or equal to, the first electromagnetic force and is an electromagnetic force applied to cut a cutting target, to the holder in the downward direction for a fourth time duration longer than the first time duration, and thus to cause a cutter to contact the cutting target, and a cutting controller that, after a predetermined time duration from the time when the electric current starts to flow in the voice coil motor, controls a carriage and a conveyor to start cutting the cutting target.

8 Claims, 9 Drawing Sheets

CUTTING DEVICE

CROSS REFERENCE TO RELATED APPLICATIONS

This application claims the benefit of priority to Japanese Patent Application No. 2017-160886 filed on Aug. 24, 2017. The entire contents of this application are hereby incorporated herein by reference.

BACKGROUND OF THE INVENTION

1. Field of the Invention

The present invention relates to a cutting device preferably to cut a cutting target such as a recording paper sheet, a plate-shaped item or the like.

2. Description of the Related Art

Conventionally, a cutting device that cuts a cutting target such as a recording paper sheet, a plate-shaped item or the like is known. Japanese Laid-Open Patent Publication No. 2011-218456 describes a cutting device including a carriage movable two-dimensionally with respect to a cutting target and a cutter mounted on the carriage and movable in an up-down direction.

In the cutting device described in Japanese Laid-Open Patent Publication No. 2011-218456, the cutter is moved in the up-down direction by a voice coil motor mounted on the carriage. More specifically, when an electric current is supplied to a coil of the voice coil motor, an electromagnetic force is generated, so that a holder holding the cutter is moved in the up-down direction.

Before the cutting target is cut, no electric current flows in the voice coil motor. Therefore, the holder holding the cutter is urged upward by an elastic body connected with the holder. Namely, the cutter is separated from the cutting target. For cutting the cutting target, an electric current is supplied to the voice coil motor to move the holder downward against the urging force of the elastic body. As a result, the cutter contacts the cutting target. Usually, the electric current flowing in the voice coil motor is set to have the level thereof gradually increased, so that the holder is gradually moved downward.

The holder is slidable with respect to a support column extending in the up-down direction. At the start of operation, the holder may not move downward smoothly by a sliding resistance between the holder and the support column. In addition, the spring constant of the elastic body urging the holder upward is varied. In the case where the urging force of the elastic body is strong, the holder may not move downward smoothly. The cutting of the cutting target starts after a predetermined time duration when the electric current starts to flow in the voice coil motor. In the case where the holder does not move smoothly as described above, the cutting of the cutting target may start, for example, before the cutter contacts the cutting target. In this case, a portion of the cutting target is not cut. If, as a result of the holder not moving smoothly, the holder is moved downward suddenly when the value of the electric current flowing in the voice coil motor is increased to some extent, the cutter may bounce on the cutting target because the cutter is moved downward too vigorously. This may decrease the quality of the cutting target.

SUMMARY OF THE INVENTION

Preferred embodiments of the present invention provide cutting devices allowing a holder holding a cutter to move downward smoothly.

A cutting device according to a preferred embodiment of the present invention includes a cutter that cuts a cutting target and is movable in an up-down direction; a cutter moving mechanism including a voice coil motor that applies a force in the up-down direction to the cutter; a carriage that is provided with the cutter moving mechanism mounted thereon and is movable in a main scanning direction; a conveyor that moves the cutting target in a sub scanning direction crossing the main scanning direction; and a controller that controls the voice coil motor, the carriage and the conveyor. The cutter moving mechanism includes a base provided on the carriage; a support column provided on the base and extending in the up-down direction; a plate provided at a top end of the support column; a holder that is located below the plate, is attached to the voice coil motor, holds the cutter, and is slidable in the up-down direction with respect to the support column; an elastic body that includes one of two ends connected with the holder and the other of the two ends connected with the plate, and urges the holder upward. The controller includes a cutter movement controller that performs a first control which controls a value of an electric current to flow in the voice coil motor to apply a first electromagnetic force to the holder in a downward direction for a first time duration, then to apply the first electromagnetic force to the holder in an upward direction for a second time duration shorter than the first time duration, to apply a second electromagnetic force smaller than the first electromagnetic force to the holder in the downward direction for a third time duration longer than the second time duration or to pause the supply of the electric current to the voice coil motor for the third time duration, then to apply a third electromagnetic force, which is smaller than, or equal to, the first electromagnetic force and is an electromagnetic force applied to cut the cutting target, to the holder in the downward direction for a fourth time duration longer than the first time duration, and thus to cause the cutter to contact the cutting target; and a cutting controller that, after a predetermined time duration from the time when the electric current starts to flow in the voice coil motor, controls the carriage and the conveyor to start cutting the cutting target; and the first time duration is set to a time period in which the cutter does not contact the cutting target when the first electromagnetic force is applied to the holder in the downward direction.

According to a cutting device according to a preferred embodiment of the present invention, the cutter movement controller first applies the first electromagnetic force to the holder in the downward direction for the first time duration. The first electromagnetic force is relatively large. Therefore, as a result of the first electromagnetic force being applied to the holder in the downward direction, the holder moves downward smoothly against the sliding resistance between the holder and the support column and against the urging force of the elastic body connected between the holder and the plate. The first time duration is set to a time period in which the cutter does not contact the cutting target. Therefore, the cutter is prevented from bouncing on the cutting target. Next, the cutter movement controller applies the first electromagnetic force to the holder in the upward direction for the second time duration shorter than the first time duration. This allows the holder moving downward at a high rate to be decelerated, and prevents the cutter from contacting the cutting target while moving at such a high rate. Then, the cutter movement controller applies the second electromagnetic force smaller than the first electromagnetic force to the holder in the downward direction for the third time duration longer than the second time duration. Alternatively, the cutter movement controller pauses the supply of the electric current to the voice coil motor for the third time duration. This causes the holder to move downward gradually. Then, the cutter movement controller applies the third electromagnetic force as the electromagnetic force applied to the holder when the cutting target is cut, to the holder in the downward direction for the fourth time duration longer than the first time duration, so that the cutter contacts the cutting target. This causes the cutter to contact the cutting target stably, and prevents the cutter from bouncing on the cutting target. After a predetermined time duration from the time when the electric current starts to flow in the voice coil motor, the cutting controller starts the cutting of the cutting target. In the case where the holder moves downward smoothly with respect to the support column, the cutter contacts the cutting target before the lapse of the predetermined time duration. Therefore, the cutting target is cut with certainty.

Preferred embodiments of the present invention provide cutting devices allowing a holder holding a cutter to move downward smoothly.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of cutting devices according to preferred embodiments of the present invention will be described with reference to the drawings. The cutting devices in the following preferred embodiments are printing-and-cutting device performing printing on a cutting target and cutting the cutting target. The preferred embodiments described below are not intended to specifically limit the present invention. Components and portions that have the same functions will bear the same reference signs, and overlapping descriptions will be omitted or simplified.

Figure 1:
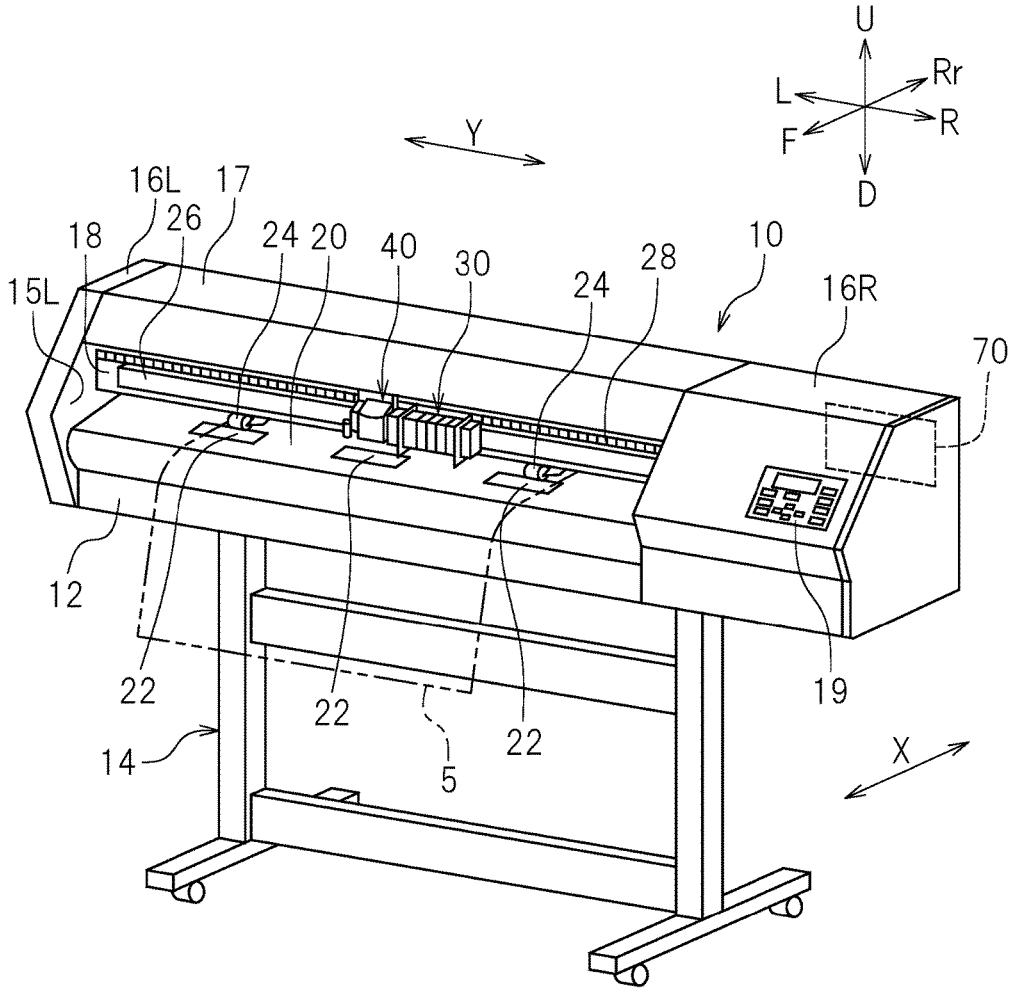
FIG. 1 is a perspective view of a cutting device according to a preferred embodiment of the present invention.

FIG. 1 is a perspective view of a cutting device 10 according to a preferred embodiment of the present invention. As shown in FIG. 1, the cutting device 10 performs printing on a cutting target 5. The cutting device 10 cuts the cutting target 5. The cutting target 5 in this preferred embodiment is, for example, a resin plate formed of an acrylic resin or the like. The cutting target 5 may be any item that can be cut, with no specific limitation. The cutting target 5 may be a relatively thick and relatively heavy plate-shaped item such as a metal plate formed of aluminum, iron or the like, a glass plate, a wood plate, a cardboard plate or the like; or a sheet-shaped item such as a recording paper sheet, a resin sheet or the like. In this specification, "cutting" encompasses cutting the cutting target 5 in the entirety of a thickness direction thereof and cutting the cutting target 5 in a portion of the thickness direction thereof.

In the following description, "left", "right", "up" and "down" respectively refer to left, right, up and down as seen from an operator who faces the cutting device 10. A direction from the cutting device 10 toward the operator is referred to as "forward" or "front", and a direction away from the operator toward the cutting device 10 is referred to as a "rearward" or "rear". In the drawings, letters F, Rr, L, R, U and D respectively represent front, rear, left, right, up and down. In the drawings, letter Y represents a main scanning direction. In this preferred embodiment, the main scanning direction Y is a left-right direction. The main scanning direction Y is, for example, a width direction of the cutting target 5. In the drawings, letter X represents a sub scanning direction. The sub scanning direction X is a direction crossing the main scanning direction Y (e.g., direction crossing the main scanning direction Y perpendicularly as seen in a plan view). In this preferred embodiment, the sub scanning direction X is a front-rear direction. These directions are merely set for the sake of convenience, and are not to be interpreted as limiting the present invention in any way.

As shown in FIG. 1, the cutting device 10 includes a main body 12, a left side cover 16L, a right side cover 16R, a top cover 17, a central wall 18, a platen 20, grit rollers 22, pinch rollers 24, a guide rail 26, a belt 28, a printing head unit 30, and a cutting head unit 40.

The main body 12 is supported by a stand 14. The main body 12 extends in the main scanning direction Y. The left side cover 16L is provided at a left end of the main body 12. The right side cover 16R is provided at a right end of the main body 12. The top cover 17 is provided above the main body 18. The top cover 17 connects the left side cover 16L and the right side cover 16R to each other. The central wall 18 extending in an up-down direction is provided above the main body 12. The central wall 18 extends in the main scanning direction Y. The central wall 18 couples the left side cover 16L and the right side cover 16R to each other.

As shown in FIG. 1, the platen 20, on which the cutting target 5 is to be placed, is provided on the main body 12. The platen 20 is provided with the grit rollers 22, which are cylindrical. The grit rollers 22 are buried in the platen 20 in a state in which a top surface of each of the grit rollers 22 is exposed. The grit rollers 22 are drivable by a feed motor 38 (see FIG. 8). The grit rollers 22 are an example of moving mechanism that moves the cutting target 5 in the sub scanning direction X. The plurality of pinch rollers 24 are provided above the grit rollers 22. The pinch rollers 24 face the grit rollers 22. The positions of the pinch rollers 24 in the up-down direction may be adjusted in accordance with the thickness of the cutting target 5. The pinch rollers 24 and the grit rollers 24 hold the cutting target 5 therebetween. The grit rollers 22 and the pinch rollers 24 move the cutting target 5 in the sub scanning direction X while holding the cutting target 5.

As shown in FIG. 1, the guide rail 26 is provided on the central wall 18. The guide rail 26 is located above the platen 20. The guide rail 26 is parallel or substantially parallel to the platen 20. The guide rail 26 extends in the main scanning direction Y. The guide rail 26 is engaged with a carriage 31 (see FIG. 2A) of the printing head unit 30 and a carriage 41 (see FIG. 2A) of the cutting head unit 40.

As shown in FIG. 1, the belt 28 is parallel or substantially parallel to a surface of the central wall 18. The belt 28 extends in the main scanning direction Y. The belt 28 is an endless belt. Pulleys (not shown) are wound around a right end and a left end of the belt 28. One of the pulleys is connected with a carriage motor 39 (see FIG. 8) driving the one pulley. When the carriage motor 39 rotates, the one pulley rotates and thus the belt 28 runs in the main scanning direction Y.

Figure 2A:
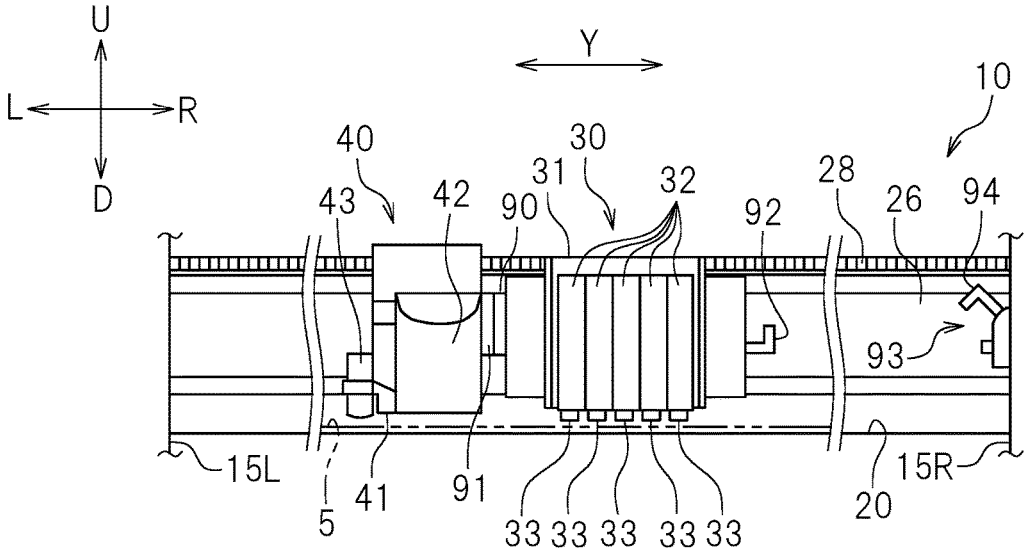
FIG. 2A is a front view showing a state in which a printing head unit and a cutting head unit are coupled with each other.

As shown in FIG. 2A, the printing head unit 30 includes the carriage 31 and ink heads 32 mounted on the carriage 31. The ink heads 32 are each provided with a plurality of nozzles 33, from which ink is discharged. In this example, five ink heads 32 are mounted on the carriage 31. The five ink heads 32 discharge five different colors of ink, for example, yellow ink, magenta ink, cyan ink, black ink and white ink. The number of the ink heads 32 is not limited to five. There is no specific limitation on the colors of the ink to be discharged by the ink heads 32.

Figure 3:
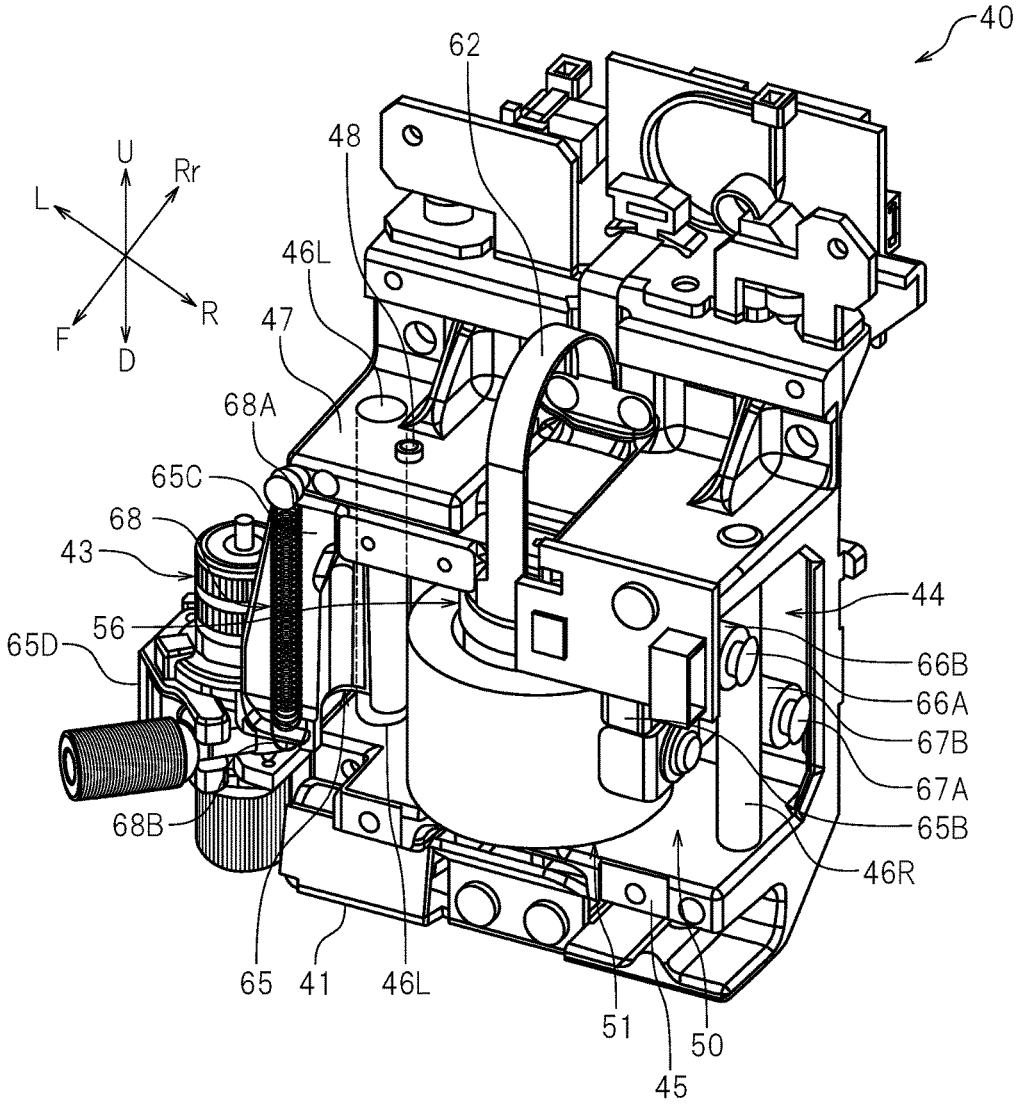
FIG. 3 is a perspective view of a cutting head according to a preferred embodiment of the present invention.

As shown in FIG. 1, the cutting head unit 40 is located to the left of the printing head unit 30. The cutting head unit 40 may be located to the right of the printing head unit 30. As shown in FIG. 3, the cutting head unit 40 includes the carriage 41, a cover 42 (see FIG. 2A), a cutter 43, and a cutter moving mechanism 44. As shown in FIG. 2A, the carriage 41 is secured to the belt 28. When the belt 28 runs, the carriage 41 moves in the main scanning direction Y along the guide rail 26. The cover 42 is detachably provided on the carriage 41. The cover 42 is located to cover a voice coil motor 50 (see FIG. 3) of the cutter moving mechanism 44. The cover 42 is located not to cover the cutter 43.

Figure 6:
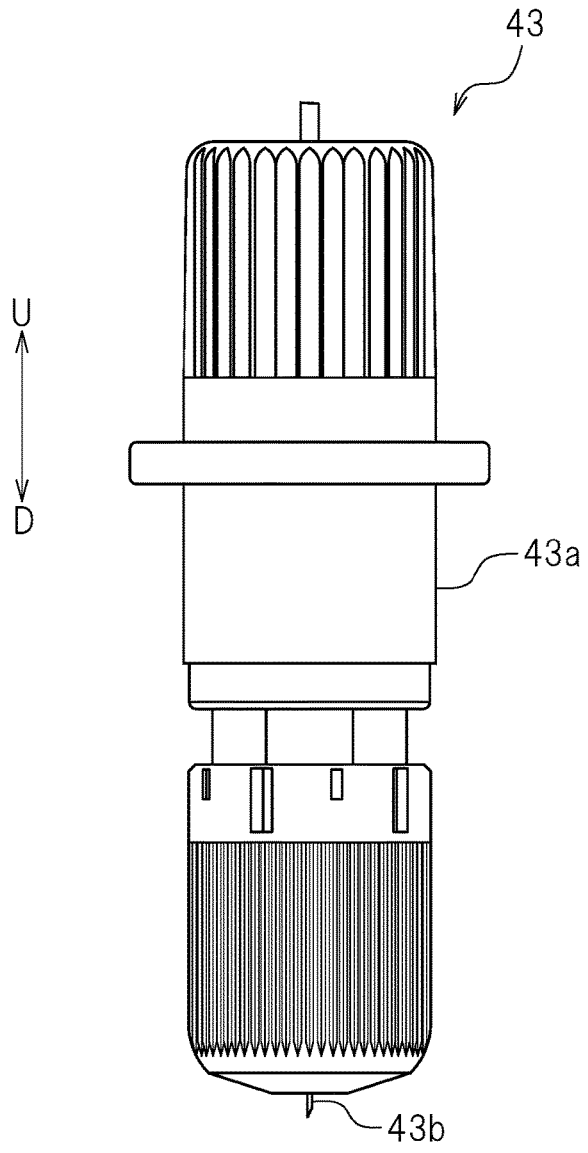
FIG. 6 is a front view of a cutter according to a preferred embodiment of the present invention.

The cutter 43 cuts the cutting target 5. The cutter 43 is provided on the cutter moving mechanism 44. The cutter 43 is movable in the up-down direction. As shown in FIG. 2A, the cutter 43 is provided to the left of the carriage 41. The cutter 43 may be provided to the right of the carriage 41. As shown in FIG. 6, the cutter 43 extends in a rod-shaped manner. The cutter 43 includes a main body case 43*a* detachably supported by the cutter moving mechanism 44 (see FIG. 3) and a blade 43*b* located in the main body case 43*a* and exposed outside from a bottom end of the main body case 43*a*. The cutting target 5 (see FIG. 1) is cut by the blade 43*b* of the cutter 43. As described above, the cutter 43 is moved in the main scanning direction Y by the carriage 41. Therefore, the blade 43*b* of the cutter 43 moves in the main scanning direction Y.

The cutter moving mechanism 44 moves the cutter 43 toward, and away from, the cutting target 5. In this preferred embodiment, the cutter moving mechanism 44 moves the cutter 43 in the up-down direction. As shown in FIG. 3, the cutter moving mechanism 44 is provided on the carriage 41. Namely, the cutter 43 and the cutter moving mechanism 44 are provided on the carriage 41 and move in the main scanning direction Y in a reciprocating manner. The carriage 41 moves the cutter 43 and the cutter moving mechanism 44 in the main scanning direction Y.

As shown in FIG. 3, the cutter moving mechanism 44 includes a base 45, a left support column 46L, a right support column 46R, a plate 47, the voice coil motor 50, a holder 65, and a spring 68. The base 45 is rectangular or substantially rectangular (encompassing a square). The base 45 is provided on the carriage 41. The left support column 46L and the right support column 46R are provided on the base 45. The left support column 46L and the right support column 46R extend in the up-down direction. The left support column 46L is located to the left of the voice coil motor 50. The right support column 46R is located to the right of the voice coil motor 50. In this preferred embodiment, the right support column 46R is located to the front of the left support column 46L. The right support column 46R may be located to the rear of the left support column 46L. The left support column 46L may be located to the front of the voice coil motor 50 and the right support column 46R may be located to the rear of the voice coil motor 50. The left support column 46L may be located to the rear of the voice coil motor 50 and the right support column 46R may be located to the front of the voice coil motor 50.

Figure 4:
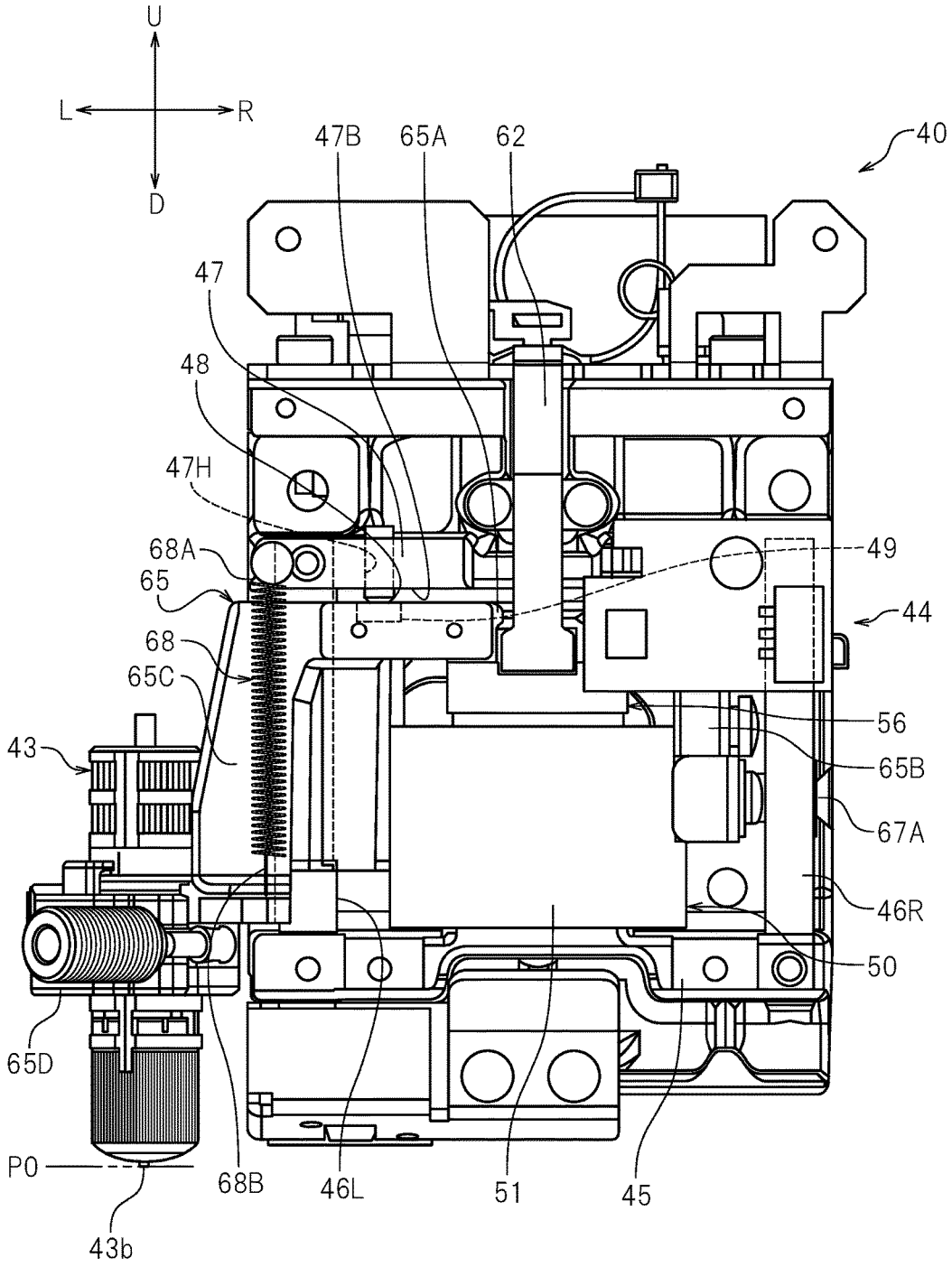
FIG. 4 is a front view of a cutting head according to a preferred embodiment of the present invention, showing a state in which a cutter is at an initial position.

As shown in FIG. 3, the plate 47 is rectangular or substantially rectangular (encompassing a square). As shown in FIG. 4, the plate 47 is located above the holder 65. The plate 47 is provided at a top end of the left support column 46L and a top end of the right support column 46R. The plate 47 is coupled with the left support column 46L and the right support column 46R. The plate 47 is provided with a protrusion 48 protruding downward from a bottom surface 47B of the plate 47. In this preferred embodiment, the plate 47 includes an insertion hole 47H, into which the protrusion 48 is inserted. The protrusion 48 is inserted into the insertion hole 47H such that a bottom end of the protrusion 48 is located below the bottom surface 47B of the plate 47. With such an arrangement, the plate 47 and the holder 65 are prevented directly contacting each other. The insertion hole 47H is threaded. The protrusion 48 has a threaded outer circumferential surface. With such an arrangement, the length of the protrusion 48 that protrudes from the bottom surface 47B of the plate 47 is adjustable.

As shown in FIG. 4, the spring 68 includes one end 68A connected with the plate 47 and the other end 68B connected with the holder 65. In this preferred embodiment, the one end 68A of the spring 68 is connected with the plate 47. The other end 65B of the spring 68 is connected with a third portion 65C (described below) of the holder 65. The spring 68 urges the holder 65 toward the plate 47. In this preferred embodiment, the spring 68 provides the holder 65 with an upward urging force. The spring 68 is an example of the elastic body.

Figure 7:
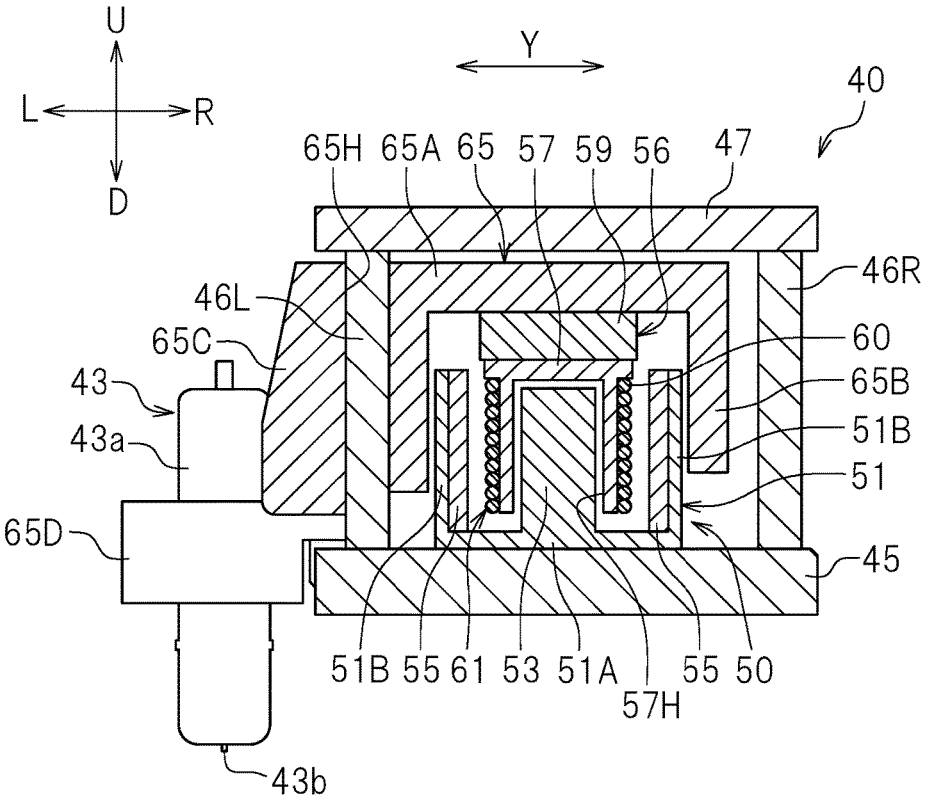
FIG. 7 is a cross-sectional view of a cutting head according to a preferred embodiment of the present invention.

The voice coil motor 50 provides the cutter 43 with a force in the up-down direction. As shown in FIG. 7, the voice coil motor 50 is located on the base 45. The voice coil motor 50 is located below the plate 47. The voice coil motor 50 includes a housing 51, a protruding member 53, a magnet 55, a coil bobbin 56, and a coil 61.

As shown in FIG. 7, the housing 51 has a cylindrical shape with a bottom. The housing 51 includes a circular bottom portion 51A and a side portion 51B extending upward from an edge of the bottom portion 51A. The protruding member 53 is provided in the housing 51. The protruding member 53 extends upward from the bottom portion 51A. The protruding member 53 extends upward from a generally central portion of the bottom portion 51A. The protruding member 53 has a cylindrical or substantially cylindrical shape, for example. The protruding member 53 is preferably integral with the housing 51 so as to define a unitary, monolithic structure. The housing 51 and the protruding member 53 are formed of, for example, iron.

As shown in FIG. 7, the magnet 55 is located in the housing 51. The magnet 55 is spaced away from the protruding member 53. The magnet 55 is located along the side portion 51B of the housing 51.

As shown in FIG. 7, the coil bobbin 56 includes a main body 57 and a head 59. The main body 57 is located between the protruding member 53 and the magnet 55. The main body 57 extends in the up-down direction. The main body 57 includes an insertion hole 57H, into which the protruding member 53 is inserted. The insertion hole 57H is opened downward. The head 59 is provided on a top end of the main body 57. The head 59 has a diameter larger than the diameter of the main body 57. The coil bobbin 56 is movable in the up-down direction along the protruding member 53. The main body 57 and the head 59 are made of a non-magnetic material. The main body 57 and the head 59 are made of, for example, a resin material.

As shown in FIG. 7, the coil 61 is defined by a winding wire 60 wound around the main body 57. The coil 61 is connected with a lead wire 62 (see FIG. 3). When an electric current is supplied to the coil 61 via the lead wire 62, an electromagnetic force (e.g., driving force) is generated in the coil 61, and as a result, the coil bobbin 56 moves downward. When the value of the electric current to be supplied to the coil 61 is increased, the electromagnetic force generated in the coil 61 is made stronger. Namely, the output of the voice coil motor 50 is increased.

As shown in FIG. 7, the holder 65 is attached to the voice coil motor 50. In this preferred embodiment, the holder 65 is attached to the head 59 of the coil bobbin 56. The holder 65 includes a first portion 65A attached to the head 59, a second portion 65B extending downward from a right end of the first portion 65A, the third portion 65C extending downward from a left end of the first portion 65A, and a fourth portion 65D extending leftward from a bottom end of the third portion 65C to support the cutter 43. The second portion 65B is located to the right of the voice coil motor 50. As shown in FIG. 3, the holder 65 includes a first shaft 66A and a second shaft 67A extending rightward from the second portion 65B. The first shaft 66A is located above the second shaft 67A. The first shaft 66A is located to the front of the second shaft 67A. The first shaft 66A is provided with a first roller 66B rotatable about the first shaft 66A. The second shaft 67A is provided with a second roller 67B rotatable about the second shaft 67A. The first roller 66B and the second roller 67B are slidable with respect to the right support column 46R. As shown in FIG. 7, the third portion 65C is located to the left of the voice coil motor 50. The third portion 65C includes an insertion hole 65H, into which the left support column 46L is inserted. The fourth portion 65D allows the main body case 43*a* of the cutter 43 to be detached therefrom. The holder 65 is slidable in the up-down direction with respect to the left support column 46L and the right support column 46R. When the holder 65 moves in the up-down direction, a sliding resistance is generated between the left support column 46L and the insertion hole 65H in the third portion 65C and between the right support column 46R and each of the first roller 66B and the second roller 67B.

As shown in FIG. 4, a cushioning body 49 is provided in a top surface of the holder 65. In more detail, the cushioning body 49 is provided in the third portion 65C of the holder 65. The cushioning body 49 may be provided in the first portion 65A of the holder 65. The cushioning body 49 is buried in the holder 65. The cushioning body 49 is located at a position facing the protrusion 48. The cushioning body 49 is located at such a position as to be allowed to contact the protrusion 48. The cushioning body 49 is made of, for example, rubber.

As shown in FIG. 2A, a coupling member 90 including a magnet is provided to the left of the carriage 31 of the printing head unit 30. The coupling member 90 is detachably coupled with a coupling member 91 provided on the carriage 41 of the cutting head unit 40. In this preferred embodiment, the coupling members 90 and 91 use a magnetic force. The coupling members 90 and 91 are not limited to using a magnetic force, and may have another structure, for example, may be engageable with each other. An L-shaped bracket 92 is provided to the right of the carriage 31.

As shown in FIG. 2A, a left side frame 15L is located at a left end of the platen 20. A right side frame 15R is located at a right end of the platen 20. The right side frame 15R is provided with a lock device 93 locking the printing head unit 30 at a wait position. The lock device 93 includes a bracket 94 that may be hooked on the bracket 92 and a lock solenoid 95 (see FIG. 8) moving the bracket 94 between a locked position (see FIG. 2B) and an unlocked position (see FIG. 2A). The lock solenoid 95 is controlled by a controller 70 described below.

Figure 2B:
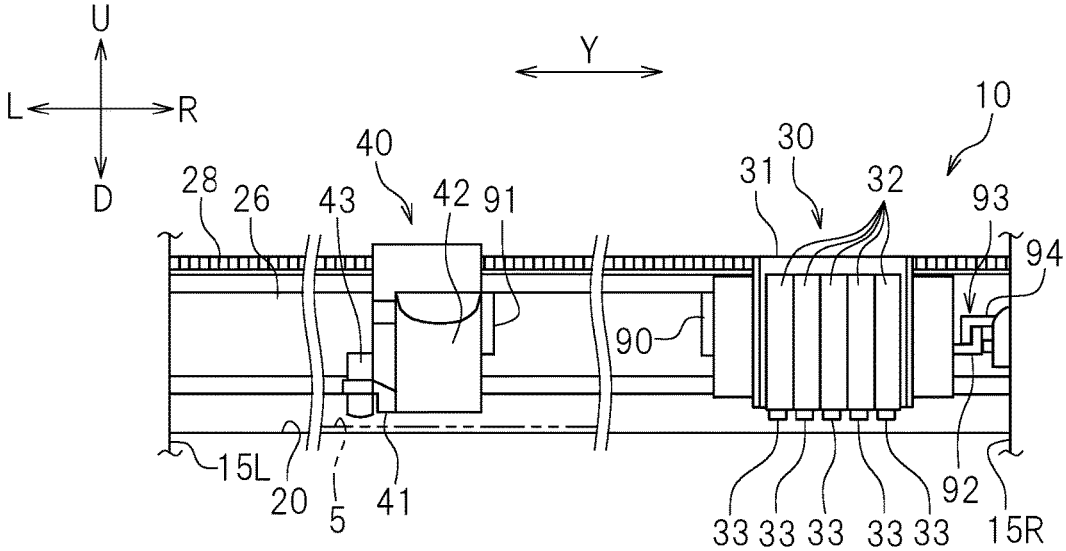
FIG. 2B is a front view showing a state in which the printing head unit and the cutting head unit are separated from each other.

As shown in FIG. 2A, in the case where printing is to be performed by the printing heat unit 30, the bracket 94 is set to the unlocked position. When the carriage 41 of the cutting head unit 40 moves rightward and thus the coupling member 90 and the coupling member 91 contact each other, the carriage 41 and the carriage 31 are coupled with each other. As a result, the printing head unit 30 is movable in the main scanning direction Y together with the cutting head unit 40. As shown in FIG. 2B, in the case where cutting is to be performed by the cutting head unit 40, the printing head unit 30 is located at the wait position, and the bracket 94 of the lock device 93 is set to the locked position. As a result, the movement of the printing head unit 30 is inhibited. When the carriage 41 moves leftward, the coupling member 90 and the coupling member 91 are separated from each other, and the carriage 41 and the carriage 31 are decoupled from each other. As a result, the cutting head unit 40 is movable in the main scanning direction Y while the printing head unit 30 stays at the wait position.

As shown in FIG. 1, an operation panel 19 is provided on a front surface of the right side cover 16R. The operation panel 19 includes a display that displays a state of printing or cutting, input keys operable by a user, and the like. The operation panel 19 is connected with the controller 70 controlling various operations of the cutting device 10.

Figure 8:
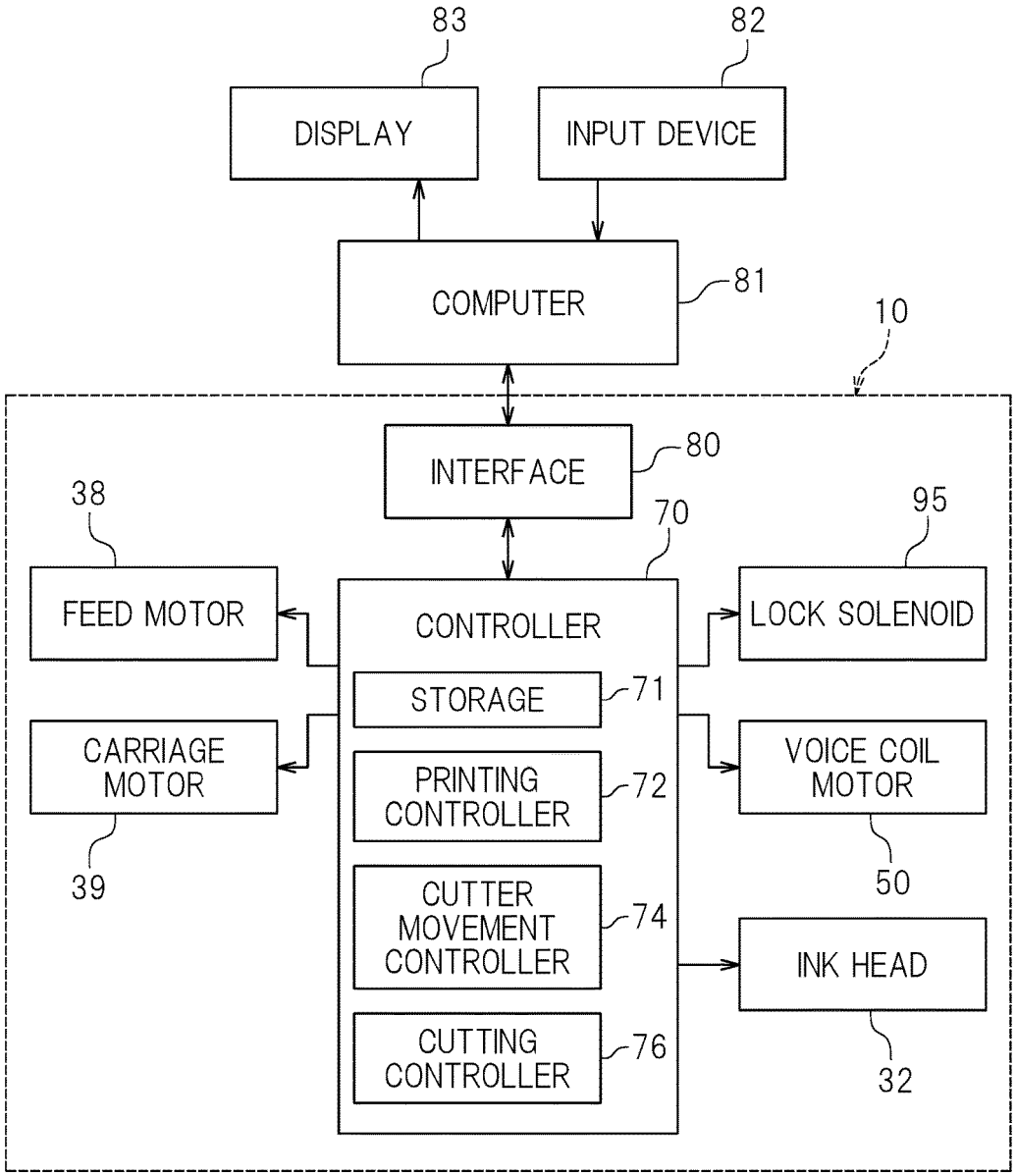
FIG. 8 is a block diagram of a controller according to a preferred embodiment of the present invention.

As shown in FIG. 8, the controller 70 controls printing on the cutting target 5 or cutting of the cutting target 5. There is no specific limitation on the structure of the controller 70. The controller 70 is, for example, a microcomputer. There is no specific limitation on the hardware structure of the microcomputer. The controller 70 includes, for example, an interface (I/F) that receives printing data or the like from an external device such as a host computer or the like, a central processing unit (CPU) that executes an instruction of a control program or the like, a ROM (read only memory) having a program executable by the CPU stored thereon, a RAM usable as a working area in which a program is developed, and a storage, such as a memory or the like, that stores a program or various types of data. As shown in FIG. 1, the controller 70 is provided in the cutting device 10. The controller 70 is communicably connected with an external computer 81 via the interface 80 in a wired or wireless manner. The computer 81 has data used to print and cut stored thereon. The controller 70 receives data from the computer 81 and controls the feed motor 38, the carriage motor 39, the lock solenoid 95 of the lock device 93, the voice coil motor 50 and the ink heads 32. As shown in FIG. 8, the computer 81 is connected with an input device 82 including a keyboard, a mouse or the like and with a display 83 including a liquid crystal display or the like.

As shown in FIG. 8, the controller 70 is configured or programmed to include a storage 71, a printing controller 72, a cutter movement controller 74, and a cutting controller 76. The functions of these elements of the controller 70 may be realized by a program, for example. This program is read from a storage medium such as, for example, a CD, a DVD or the like. This program may be downloaded via the Internet. The functions of the elements of the controller 70 may be realized by a processor and/or a circuit.

The storage 71 stores printing data used to print an image and cut data representing a cutting line for the image, along which the cutting target 5 is cut by the cutter 43. Such data is transmitted from, for example, the external computer 81.

The printing controller 72 executes control of printing an image on a surface of the cutting target 5 by use of the ink heads 32. In this preferred embodiment, the printing controller 72 drives the carriage motor 39 to move the ink heads 32 in the main scanning direction Y via the carriage 41 while causing ink to be discharged from each of the nozzles 33 of the ink heads 32. In this manner, printing is performed for one scanning line. When the movement of the ink heads 32 in the main scanning direction Y is finished, the printing controller 72 drives the feed motor 38 to move the cutting target 5 in the sub scanning direction X to the position of the next scanning line. When the movement of the cutting target 5 in the sub scanning direction X is finished, the printing controller 72 drives, again, the carriage motor 39 to move the carriage 32 to perform printing for the next scanning line. Thereafter, the same operation is repeated until the printing is finished.

The cutter movement controller 74 controls the voice coil motor 50 to move the cutter 43 in the up-down direction. More specifically, the cutter movement controller 74 controls the value of the electric current flowing in the voice coil motor 50 to provide the holder 65 with an electromagnetic force in the up-down direction. In this manner, the force in the up-down direction is applied to the cutter 43.

Figure 9:
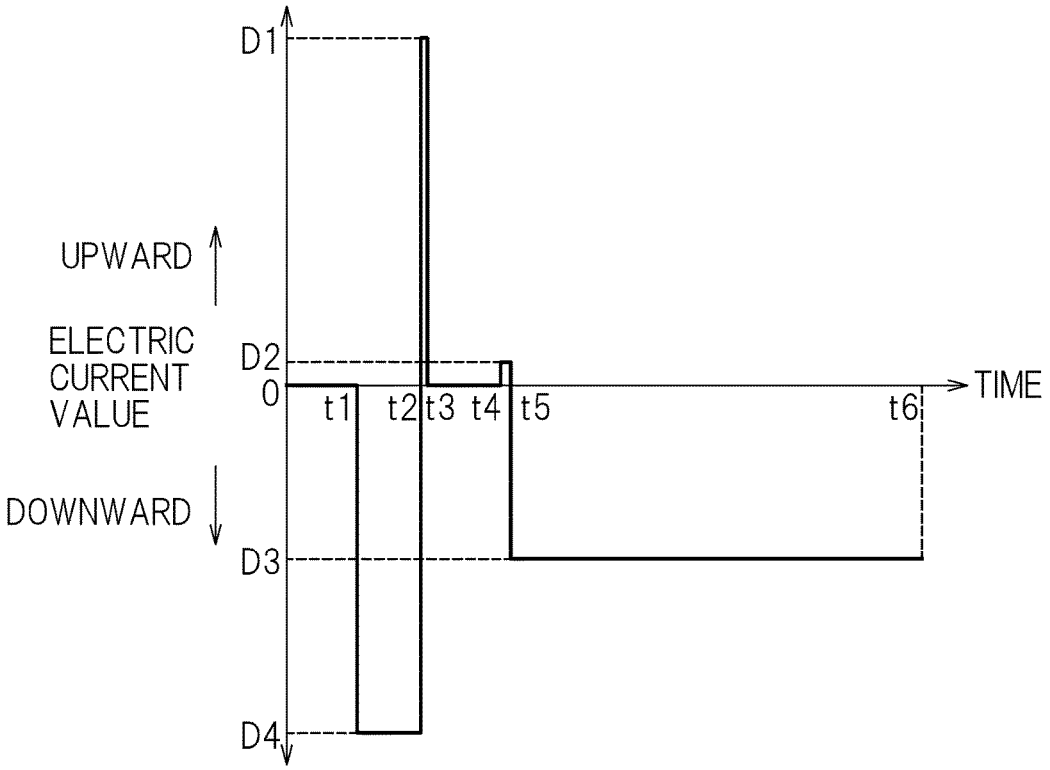
FIG. 9 is a graph showing a relationship between the value of the electric current flowing in a voice coil motor and the time.
Figure 10:
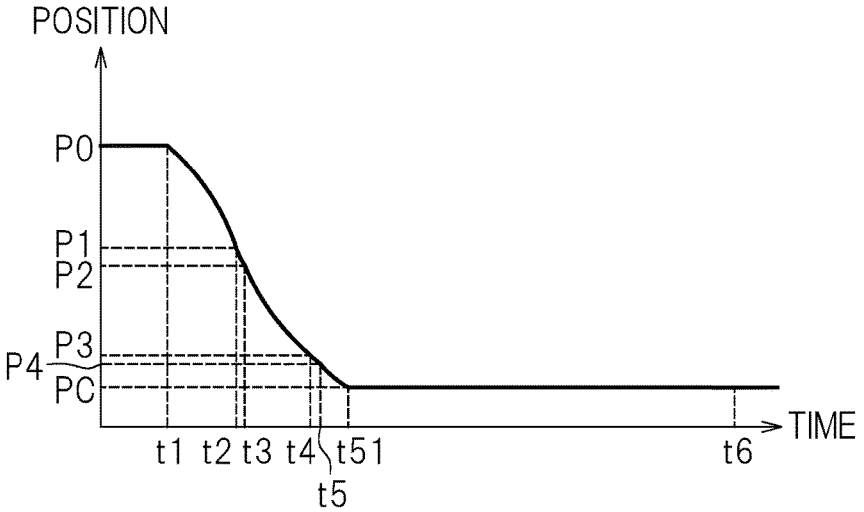
FIG. 10 is a graph showing a relationship between the position of the cutter and the time.

As shown in FIG. 9, first, at time t1, the cutter movement controller 74 causes an electric current having a positive current value D4 to flow in the voice coil motor 50 for a first time duration. When the electric current having such a positive current value flows in the voice coil motor 50, a downward force is applied to the holder 65 (i.e., the cutter 43). In this manner, the cutter movement controller 74 applies a first electromagnetic force to the holder 65 in a downward direction for the first time duration. At this point, the cutter 43 moves downward via the holder 65. The value of the electric current flowing in the voice coil motor 50 is, for example, about 10 mA to about 250 mA. Namely, the electromagnetic force that is allowed to be applied to the holder 65 is, for example, about 30 gf to about 500 gf. The current value D4 is, for example, about 40% to about 100% (e.g., 100%) of the value of the electric current that is allowed to flow in the voice coil motor 50. The current value D4 is, for example, the maximum value of the current that is allowed to flow in the voice coil motor 50. Namely, the first electromagnetic force is the maximum electromagnetic force that is allowed to be applied to the holder 65 by the voice coil motor 50. In this preferred embodiment, the first electromagnetic force is about 500 gf, for example. The first time duration (i.e., time t2−time t1) is set to a time period in which the cutter 43 does not contact the cutting target 5 when the first electromagnetic force is applied to the holder 65 in the downward direction. The first time duration is, for example, calculated experimentally in advance and stored in the storage 71. The first time duration varies in accordance with the thickness of the cutting target 5. The first time duration is, for example, about 10 ms. As shown in FIG. 10, in the time duration from time t1 to time t2, the cutter 43 moves downward vigorously from an initial position P0 (also see FIG. 4) to a first position P1.

Then, as shown in FIG. 9, at time t2, the cutter movement controller 74 causes an electric current having a negative current value D1 to flow in the voice coil motor 50 for a second time duration. When the electric current having such a negative current value flows in the voice coil motor 50, an upward force is applied to the holder 65 (i.e., the cutter 43). In this manner, the cutter movement controller 74 applies the first electromagnetic force to the holder 65 in an upward direction for the second time duration (i.e., time t3−time t2). At this point, the cutter 43 moving downward is decelerated. In this preferred embodiment, the current value D1 and the current value D4 have an equal absolute value. The second time duration is shorter than the first time duration. The second time duration is at most about half (e.g., at most about 1/10) of the first time duration. The second time duration is, for example, about 1 ms. As shown in FIG. 10, in the time duration from time t2 to time t3, the cutter 43 moves downward in a decelerated manner from the first position P1 to a second position P2.

Then, as shown in FIG. 9, at time t3, the cutter movement controller 74 stops the supply of the electric current to the voice coil motor 50. In this example, the cutter movement controller 74 pauses the supply of the electric current for a third time duration (time t4−time t3). At this point, the cutter 43 keeps moving downward by an electromagnetic force smaller than the first electromagnetic force applied during the first time duration of time t1 to time t2. The third time duration is longer than the second time duration. The third time duration is, for example, equal to the first time duration. The cutter movement controller 74 stops the supply of the electric current to the voice coil motor 50 at time t3. The present invention is not limited to this. For example, at time t3, the cutter movement controller 74 may cause an electric current having a positive current value DX to flow in the voice coil motor 50 for the third time duration. In this manner, the cutter movement controller 74 applies a second electromagnetic force to the holder 65 in the downward direction for the third time duration. The current value DX is at most about 1/10 (e.g., at most 1/20) of the current value D4, for example. At this point, the cutter 43 moving downward is accelerated. As shown in FIG. 10, in the time duration from time t3 to time t4, the cutter 43 moves downward gradually from the second position P2 to a third position P3.

Then, as shown in FIG. 9, at time t4, the cutter movement controller 74 causes an electric current having a negative current value D2 to flow in the voice coil motor 50 for a fifth time duration. In this manner, the cutter movement controller 74 applies a fourth electromagnetic force to the holder 65 in the upward direction for the fifth time duration (i.e., time t5–time t4). At this point, the cutter 43 moving downward is decelerated. The fourth electromagnetic force is smaller than a third electromagnetic force applied to the holder 65 when the cutting target 5 is to be cut. In this preferred embodiment, the current value D2 is about 1% to about 20% (e.g., about 10%) of the value of the electric current that is allowed to flow in the voice coil motor 50. The current value D2 is, for example, the minimum value of the electric current that is allowed to flow in the voice coil motor 50. Namely, the fourth electromagnetic force is the minimum electromagnetic force that is allowed to be applied to the holder 65 by the voice coil motor 50. In this preferred embodiment, the fourth electromagnetic force is about 30 gf, for example. The fifth time duration is shorter than the first time duration. The fifth time duration is at most about half (e.g., at most about 1/10) of the first time duration, for example. The fifth time duration is, for example, equal or substantially equal to the second time duration. The fifth time duration is, for example, about 1 ms. As shown in FIG. 10, in the time duration from time t4 to time t5, the cutter 43 moves downward in a decelerated manner from the third position P3 to a fourth position P4.

Figure 5:
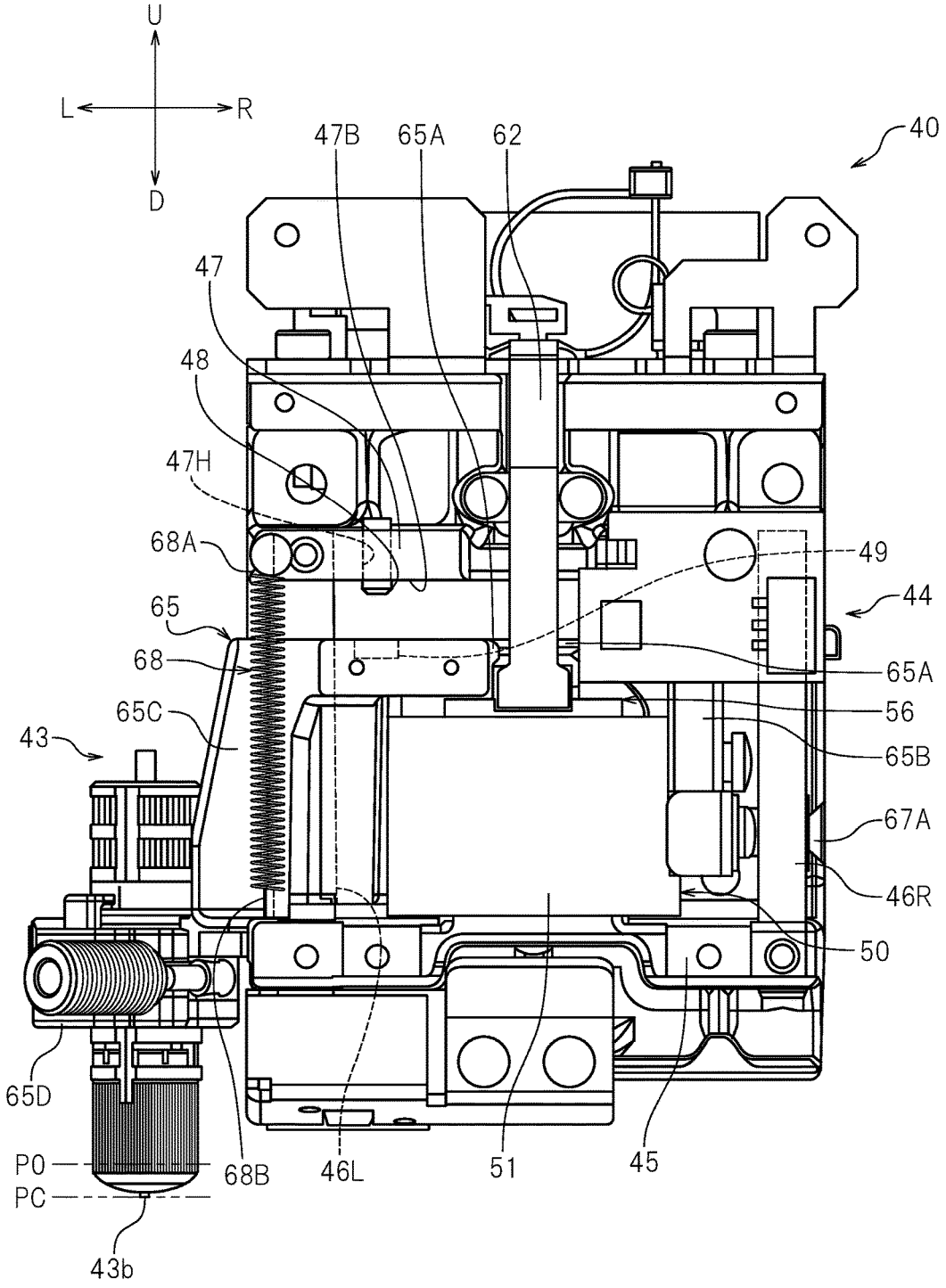
FIG. 5 is a front view of a cutting head according to a preferred embodiment of the present invention, showing a state in which the cutter is at a cutting position.

Then, as shown in FIG. 9, at time t5, the cutter movement controller 74 causes an electric current having a positive current value D3 to flow in the voice coil motor 50 for a fourth time duration. In this manner, the cutter movement controller 74 applies the third electromagnetic force to the holder 65 in the downward direction for a fourth time duration (i.e., time t6–time t5). At this point, the cutter 43 moving downward is accelerated. The third electromagnetic force is an electromagnetic force applied to the holder 65 when the cutting target 5 is to be cut. The third electromagnetic force is smaller than, or equal to, the first electromagnetic force. The third electromagnetic force is about 30 gf to about 500 gf, for example. In this preferred embodiment, the third electromagnetic force is about 250 gf, for example. The fourth time duration is longer than the first time duration. The fourth time duration is at least about twice (e.g., at least about four times and at most about 10 times) the first time duration, for example. The fourth time duration is, for example, about 60 ms. As shown in FIG. 10, in the time duration from time t5 to time t51, the cutter 43 moves downward in an accelerated manner from the fourth position P4 to a cutting position PC (also see FIG. 5). At time t51, the cutter 43 contacts the cutting target 5. The cutter 43 moves downward in an accelerated manner in the time duration from time t5 to time t51. At this point, the cutter 43 is sufficiently close to the cutting target 5, and thus is prevented bouncing on the cutting target 5. The cutter 43 waits for a time duration from time t51 to time t6, so as to be stabilized with respect to the cutting target 5. The time duration from time t51 to t6 is longer than a time duration from time t1 to time t51.

The cutting controller 76 executes control of cutting the cutting target 5 by use of the cutter 43. After a predetermined time duration from the time when the electric current starts to flow in the voice coil motor 50, the cutting controller 76 controls the carriage 41 of the cutting head unit 40 and the grit rollers 22. In the example shown in FIG. 9, the cutting controller 76 starts the cutting of the cutting target 5 at time t6. In the example shown in FIG. 9, the "predetermined time duration" is represented by time t6–time t1, and is a time duration from the time when the electric current starts to flow in the voice coil motor 50 until the cutter 43 is stabilized with respect to the cutting target 5. In the case where the holder 65 moves downward smoothly along the left support column 46L and the right support column 46R, the time duration required for the cutter 43 to move from the initial position P0 to the cutting position PC is shorter than the predetermined time duration. In this preferred embodiment, the cutting controller 76 drives the feed motor 38, as well as the carriage motor 39, to move the cutter 43 with respect to the cutting target 5 two-dimensionally. In this manner, the cutting target 5 is cut along any cutting line.

As described above, according to the cutting device 10 in this preferred embodiment, the cutter movement controller 74 first applies the first electromagnetic force to the holder 65 in the downward direction for the first time duration. The first electromagnetic force is relatively large (e.g., the maximum electromagnetic force that is allowed to be applied to the holder 65). Therefore, as a result of the first electromagnetic force being applied to the holder 65 in the downward direction, the holder 65 moves downward smoothly against the sliding resistance between the holder 65 and each of the left support column 46L and the right support column 46R and against the urging force of the spring 68 connected between the holder 65 and the plate 47. The first time duration is set to a time period in which the cutter 43 does not contact the cutting target 5. Therefore, the cutter 43 is prevented from bouncing on the cutting target 5. Next, the cutter movement controller 74 applies the first electromagnetic force to the holder 65 in the upward direction for the second time duration shorter than the first time duration. This allows the holder 65 moving downward at a high rate to be decelerated, and prevents the cutter 43 from contacting the cutting target 5 while moving at such a high rate. Then, the cutter movement controller 74 applies the second electromagnetic force smaller than the first electromagnetic force to the holder 65 in the downward direction for the third time duration longer than the second time duration. This causes the holder 65 to move downward gradually. Then, the cutter movement controller 74 applies the third electromagnetic force as the electromagnetic force applied to the holder 65 when the cutting target 5 is to be cut, to the holder 65 in the downward direction for the fourth time duration longer than the first time duration, so that the cutter 43 contacts the cutting target 5. This causes the cutter 43 to contact the cutting target 5 stably, and prevents the cutter 43 from bouncing on the cutting target 5. A predetermined time duration after the electric current starts to flow in the voice coil motor 50, the cutting controller 76 starts the cutting of the cutting target 5. In the case where the holder 65 moves downward smoothly with respect to the left support column 46L and the right support column 46R, the cutter 43 contacts the cutting target 5 before the lapse of the predetermined time duration. Therefore, the cutting target 5 is cut with certainty.

In the cutting device 10 in this preferred embodiment, the holder 65 is attached to the head 59 of the coil bobbin 56. This allows the electromagnetic force generated in the voice coil motor 50 to be easily applied to the holder 65.

In the cutting device 10 in this preferred embodiment, the cutter movement controller 74 stops the supply of the electric current to the voice coil motor 50 and then applies the fourth electromagnetic force smaller than the third electromagnetic force to the holder 65 in the upward direction for the fifth time duration shorter than the third time duration. This allows the holder 65 moving downward gradually to be further decelerated and thus allows the cutter 43 to contact the cutting target 5 gently. As a result, the cutter 43 is prevented bouncing on the cutting target 5.

According to the cutting device 10 in this preferred embodiment, the first electromagnetic force is the maximum electromagnetic force that is allowed to be applied to the holder 65 by the voice coil motor 50, and the fourth electromagnetic force is the minimum electromagnetic force that is allowed to be applied to the holder 65 by the voice coil motor 50. The first electromagnetic force and the fourth first electromagnetic force are applied as described above, so that the holder 65 moves downward with certainty at the start of operation of the holder 65, and the holder 65 moving downward gradually is decelerated appropriately to allow the cutter 43 to contact the cutting target 5 gently. As a result, the cutter 43 is prevented bouncing on the cutting target 5.

According to the cutting device 10 in this preferred embodiment, the second time duration is at most half of the first time duration. The second time duration is used as described above, so that the holder 65 moving downward is decelerated appropriately, and the time duration, required from the initial operation of the holder 65 until the cutter 43 contacts the cutting target 5, is prevented from being excessively extended.

In the cutting device 10 in this preferred embodiment, the cushioning body 49 allowed to contact the protrusion 48, protruding downward from the bottom surface 47B of the plate 47, is provided on the top surface of the holder 65, at a position facing the protrusion 48. This prevents the holder 65 and the plate 47 from directly contacting each other and prevents generation of an abnormal sound, which would have been otherwise caused due to the contact of the holder 65 and the plate 47. The protrusion 48 and the cushioning body 49 contact each other, instead of the holder 65 and the plate 47. Since the cushioning body 49 alleviates the collision of the protrusion 48, generation of an abnormal sound is significantly reduced or prevented.

In the cutting device 10 in this preferred embodiment, the cushioning body 49 is made of rubber, for example. Since rubber has a property of absorbing a sound of collision, generation of an abnormal sound is more effectively reduced or prevented when the protrusion 48 collides against the cushioning body 49 made of rubber. During the time duration when no electric current flows in the voice coil motor 50, the cushioning body 49 and the protrusion 48 are in contact with each other by the urging force of the spring 68. Since the cushioning body 49 is made of rubber, the protrusion 48 may be stuck to the cushioning body 49. In such a case, a force greater than usually required may be needed to peel the protrusion 48 from the cushioning body 49. However, according to the cutting device 10 in this preferred embodiment, the cutter movement controller 74 first applies the first electromagnetic force, which is relatively large, to the holder 65. Therefore, the protrusion 48 is easily peeled off from the cushioning body 49, and thus the holder 65 moves downward smoothly.

The cutting device 10 in this preferred embodiment includes the ink heads 32 performing printing on the cutting target 5. Therefore, the cutting target 5 may be cut soon after printing is performed on the cutting target 5.

Some preferred embodiments of the present invention are described above. The above-described preferred embodiments are merely examples, and the present invention may be carried out in various other preferred embodiments.

In the above-described preferred embodiments, the cutting device 10 includes the printing head unit 30. The cutting device 10 is not limited to this. The cutting device 10 does not need to include the printing head unit 30 as long as including the cutting head unit 40.

In the above-described preferred embodiments, at time t4, the cutter movement controller 74 causes the electric current having the negative current value D2 to flow in the voice coil cutter 50 for the fifth time duration. The cutter movement controller 74 is not limited to this. After the supply of the electric current to the voice coil motor 50 is paused in the time duration from time t3 to time t4, or after the electric current having the positive current value DX flows in the voice coil motor 50 in the time duration from time t3 to time t4, the cutter movement controller 74 may cause the electric current having the positive current value D3 to flow in the voice coil motor 50 for the fourth time duration. Namely, the electric current having the negative current value D2 does not need to flow in the voice coil motor 50.

In the above-described preferred embodiments, at time t2, the cutter movement controller 74 causes the electric current having the negative current value D1 to flow in the voice coil motor 50. The cutter movement controller 74 is not limited to this. The cutter movement controller 74 may cause an electric current having a current value that is at most 100% of the negative current value D1, for example, about 70% to about 95% of the negative current value D1, to flow in the voice coil motor 50 at time t2.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A cutting device, comprising:

a cutter that cuts a cutting target and is movable in an up-down direction;

a cutter moving mechanism including a voice coil motor that applies a force in the up-down direction to the cutter;

a carriage that includes the cutter moving mechanism mounted thereon and is movable in a main scanning direction;

a conveyor that moves the cutting target in a sub scanning direction crossing the main scanning direction; and a controller that controls the voice coil motor, the carriage and the conveyor; wherein the cutter moving mechanism includes:

a base provided on the carriage;

a support column provided on the base and extending in the up-down direction;

a plate provided at a top end of the support column;

a holder that is located below the plate, is attached to the voice coil motor, holds the cutter, and is slidable in the up-down direction with respect to the support column;

an elastic body that includes one of two ends connected with the holder and the other of the two ends connected with the plate, and urges the holder upward;

the controller includes:

a cutter movement controller that performs a first control which controls a value of an electric current to flow in the voice coil motor to apply a first electromagnetic force to the holder in a downward direction for a first time duration, then to apply the first electromagnetic force to the holder in an upward direction for a second time duration shorter than the first time duration, to apply a second electromagnetic force smaller than the first electromagnetic force to the holder in the downward direction for a third time duration longer than the second time duration or to pause the supply of the electric current to the voice coil motor for the third time duration, then to apply a third electromagnetic force, which is smaller than, or equal to, the first electromagnetic force and is an electromagnetic force applied to cut the cutting target, to the holder in the downward direction for a fourth time duration longer than the first time duration, and thus to cause the cutter to contact the cutting target; and a cutting controller that, after a predetermined time duration from the time when the electric current starts to flow in the voice coil motor, controls the carriage and the conveyor to start cutting the cutting target; and the first time duration is set to a time period in which the cutter does not contact the cutting target when the first electromagnetic force is applied to the holder in the downward direction.

2. The cutting device according to claim 1, wherein the voice coil motor includes:

a cylindrical housing with a bottom;

a protruding member provided in the housing and extending upward from the bottom;

a magnet located in the housing and away from the protruding member; and a coil bobbin that includes a main body that is located between the protruding member and the magnet and includes an insertion hole opened downward and to which the protruding member is inserted, further includes a head provided at a top end of the main body, and is movable in the up-down direction along the protruding member; and a coil including a winding wire wound around the main body; and the holder is attached to the head of the coil bobbin.

3. The cutting device according to claim 1, wherein instead of the first control, the cutter movement controller performs a second control which controls the voice coil motor to apply the first electromagnetic force to the holder in the downward direction for the first time duration, then to apply the first electromagnetic force to the holder in the upward direction for the second time duration, to apply the second electromagnetic force to the holder in the downward direction for the third time duration or to pause the supply of the electric current to the voice coil motor for the third time duration, then to apply a fourth electromagnetic force smaller than the third electromagnetic force to the holder in the upward direction for a fifth time duration shorter than the third time duration, then to apply the third electromagnetic force to the holder in the downward direction for the fourth time duration, and thus to cause the cutter to contact the cutting target.

4. The cutting device according to claim 3, wherein the first electromagnetic force is a maximum electromagnetic force applicable to the holder by the voice coil motor; and the fourth electromagnetic force is a minimum electromagnetic force applicable to the holder by the voice coil motor.

5. The cutting device according to claim 1, wherein the second time duration is at most about one half of the first time duration.

6. The cutting device according to claim 1, wherein the support column includes a first support column extending in the up-down direction and a second support column located to the side of the first support column and extending in the up-down direction;

the plate is located at a top end of the first support column and a top end of the second support column;

the cutter moving mechanism includes a protrusion protruding downward from a bottom surface of the plate; and the cutting device further includes a cushioning body, contactable with the protrusion, and located on a top surface of the holder at a position facing the protrusion.

7. The cutting device according to claim 6, wherein the cushioning body is made of rubber.

8. The cutting device according to claim 1, further comprising an ink head that performs printing on the cutting target.

* * * * *